US006192699B1

(12) United States Patent
Kato et al.

(10) Patent No.: US 6,192,699 B1
(45) Date of Patent: Feb. 27, 2001

(54) VARIABLE CAPACITY COMPRESSOR

(75) Inventors: Keiichi Kato; Hajime Kurita; Hirotaka Kurakake; Masaki Ota, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/290,573

(22) Filed: Apr. 13, 1999

(30) Foreign Application Priority Data

Apr. 17, 1998 (JP) ..... 10-107540

(51) Int. Cl.[7] ..... F25B 1/00
(52) U.S. Cl. ..... 62/228.3; 417/222.2
(58) Field of Search ..... 62/228.3, 228.5; 417/222.2

(56) References Cited

U.S. PATENT DOCUMENTS

| | | | | |
|---|---|---|---|---|
| Re. 35,672 | * | 11/1997 | Taguchi | 417/222.2 |
| 4,880,356 | * | 11/1989 | Suzuki et al. | 417/53 |
| 4,905,477 | * | 3/1990 | Takai | 62/196.3 |
| 5,567,124 | * | 10/1996 | Takenaka et al. | 417/222.2 |
| 5,702,235 | * | 12/1997 | Hirota et al. | 417/222.2 |
| 5,842,834 | | 12/1998 | Kawaguchi et al. | 417/222.2 |
| 5,871,337 | | 2/1999 | Fukanuma et al. | 417/222.2 |
| 6,056,513 | * | 5/2000 | Kawaguchi et al. | 417/222.1 |
| 6,123,513 | * | 9/2000 | Hiramatsu et al. | 417/222.2 |

FOREIGN PATENT DOCUMENTS

| | | |
|---|---|---|
| 19633533 A1 | 2/1997 | (DE) . |
| 19644431 A1 | 4/1997 | (DE) . |
| 0711918 A2 | 5/1996 | (EP) . |
| 3-6875 | 2/1991 | (JP) . |
| 7-332250 | 12/1995 | (JP) . |

* cited by examiner

*Primary Examiner*—Corrine McDermott
*Assistant Examiner*—Malik N. Drake
(74) *Attorney, Agent, or Firm*—Morgan & Finnegan, L.L.P.

(57) ABSTRACT

A compressor includes a transpire passageway exclusively communicated with a suction pressure area, and a throttle constituted by a clearance gap between an inner peripheral surface of an end portion of the shaft hole adjoining a crankcase chamber and an outer peripheral surface of a drive shaft. The transpire passageway has one end passageway portion being opened at a sealed portion sealed by a shaft sealing member disposed in a shaft hole. The transpire passageway has another end passageway portion being opened a suction pressure area.

9 Claims, 3 Drawing Sheets

VARIABLE CAPACITY COMPRESSOR

BACKGROUND OF THE INVENTION

1. Field of the Invention

The present invention relates to a variable capacity compressor. The present invention is applicable to refrigerant compressors, in particular, variable capacity compressors having single-head-type pistons.

2. Description of Related Art

There has been a variable capacity compressor which is a wobble type or a swash type and which is mainly employed for vehicle air-conditioners. The variable capacity compressor has a cam plate which is connected with a rotor by way of a hinge mechanism and which is to be oscillated around a fulcrum. The compressor varies a pressure of a crankcase chamber having the cam plate, controlling a force working to the rear surface of the single-head-type piston, and balancing the rear surface and the front surface of the single-head-type piston. Accordingly, the compressor varies an inclination angle of the cam plate around the fulcrum of the cam plate. Namely, the compressor varies a piston-stroke.

The compressor sucks a refrigerant gas, which returns from an exterior refrigerating circuit, from a suction chamber, supplying the sucked refrigerant gas into bores by reciprocating the pistons, compressing the refrigerant gas, and thereby discharging the refrigerant gas into a discharge chamber. As aforedescribed, the compressor has a construction in which the refrigerant gas doesn't pass through the crankcase chamber but directly flows into the bores fitting the corresponding pistons. Accordingly, lubricating ability with respect to sliding parts disposed in the crankcase chamber depends on a blow-by gas leaked to the crankcase chamber. Also, lubricating ability with respect to the sliding parts in the crankcase chamber depends on lubricating oil contained in the refrigerant gas in discharge pressure which is positively supplied into the crankcase chamber during capacity-control to change the pressure in the crankcase chamber.

The conventional compressor is provided with a shaft sealing member arranged for sealing an exposed end portion of the drive shaft. Since the shaft sealing member is arranged in a shaft hole, located apart from the crankcase chamber, the refrigerant gas flowing toward the shaft sealing member is extremely decreased in quantity. As a result, the compressor causes secondary anxiety that the shaft sealing member is heat-deteriorated by shortage of the lubricating and the cooling, and that a clutch slips by gas-leakage.

Japanese Unexamined Patent Publication No. 7-332,250 discloses the compressor in which an appended passageway is disposed in the inside of a drive shaft along a shaft centre thereof. One end passageway portion of the appended passageway is opened in a shaft hole of a front housing, and another end passageway portion of the appended passageway is communicated with a suction pressure area. Also, this publication discloses a technique that the refrigerant gas in the crankcase chamber flows into the suction pressure area by way of the neighborhood of the shaft sealing member.

Judging from view that it is preferable that the shaft sealing member is fully lubricated and cooled, such construction concerning the publication is not satisfied. The reason is that the refrigerant gas—a flow stream from the crankcase chamber to the suction pressure area—is not limited only within the aforesaid appended passageway formed in the inside of the drive shaft. Namely, the refrigerant gas flows into the suction pressure area, not only by way of the aforesaid appended passageway but also by way of another passageway which passes through the radial bearing for supporting the drive shaft arranged in a central hole of a cylinder block.

In other words, since the refrigerant gas flows in two-passageways in the aforedescribed way, less lubricating oil is supplied to the shaft sealing member with the refrigerant gas, as a logical consequence. Also, a pressure reduction is not largely generated at a sealed portion sealed by the shaft sealing member; so, it is apparent that the conventional compressor concerning the aforesaid publication does not cool the shaft sealing member effectively.

SUMMARY OF THE INVENTION

The present invention has been developed in view of the aforementioned circumstances. It is therefore an object of the present invention to provide a variable capacity compressor which improves endurance of a shaft sealing member by designating a transpire passageway connected with a crankcase chamber and a suction pressure area.

In the first aspect of the present invention, a variable capacity compressor comprises: (1) a cylinder block including a plurality of bores arranged therein, constituting a body of the compressor, and having a front end and a rear end; (2) a front housing including a shaft hole, and a crankcase chamber disposed in the inside thereof, the front housing closing the front end of the cylinder block, and the crankcase chamber having a rotor and a hinge mechanism; (3) a drive shaft rotatably supported by the cylinder block and the front housing, the drive shaft having an end portion disposed in the shaft hole of the front housing; (4) a shaft sealing member disposed in the shaft hole between the drive shaft and the front housing for sealing the shaft hole of the front housing; (5) a rear housing including a suction pressure area and a discharge pressure area, and the rear housing closing the rear end of the cylinder block; (6) a cam plate connected to be inclined with respect to the drive shaft, and connected with the rotor by way of the hinge mechanism to synchronously be rotated with the drive shaft; (7) a plurality of pistons associated with the cam plate for reciprocating in each of the bores; (8) a capacity control valve for controlling a pressure of the crankcase chamber by supplying a discharge pressure from the discharge pressure area to the crankcase chamber, the capacity control valve for varying an inclination angle and a piston stroke on the basis of a differential pressure between a suction pressure and the pressure of the crankcase chamber; and (9) the improvement comprising;

(9-1) a transpire passageway exclusively communicated with a suction pressure area, having one end passageway portion being opened at a sealed portion being sealed by the shaft sealing member disposed in the shaft hole, and having another end passageway portion being opened the suction pressure area; and (9-2) a throttle constituted by a clearance gap between an inner peripheral surface of an end portion of the shaft hole adjoining the crankcase chamber and an outer peripheral surface of the drive shaft.

In the first aspect of the present invention, the sealed portion sealed by the shaft sealing member is communicated with the crankcase chamber by way of the shaft hole of the front housing. Also, the sealed portion sealed by the shaft sealing member is communicated with the suction pressure area, which indicates a lower pressure, by the transpire passageway. Accordingly, an exclusive flow stream is generated in the refrigerant gas of the crankcase chamber, the exclusive flow stream moves toward the transpire passageway by way of the shaft sealing member because of a pressure difference. Therefore, the shaft sealing member is effectively lubricated and cooled by the flow stream.

In the case of a compressor which controls a capacity by controlling a pressure of the crankcase chamber, namely, by increasing a pressure of the crankcase chamber, the refrigerant gas is positively supplied to the crankcase chamber, and accordingly, the shaft sealing member is more effectively lubricated and cooled. Also, the throttle, communicated with the transpire passageway, is constituted by a clearance gap between an inner peripheral surface of an end portion of the shaft hole adjoining the crankcase chamber and an outer peripheral surface of the drive shaft. Therefore, the throttle decreases a back pressure of the shaft sealing member to the same pressure as the suction pressure area, thereby remarkably decreasing load applied to the shaft sealing member, and thereby obtaining a cooling ability caused by a pressure reduction resulting from the throttle.

In the first aspect of the present invention, the compressor has the transpire passageway being exclusively communicated with a suction pressure area by way of the shaft sealing member, and the compressor has the throttle formed at the end portion of the shaft hole which corresponds with a starting location of the transpire passageway and which adjoins the crankcase chamber. In the first aspect of the present invention, the shaft sealing member is considerably improved in endurance.

In the second aspect of the present invention, since the transpire passageway passes through the body of the front housing, the body of the cylinder block, and the body of the rear housing; so, the transpire passageway is concisely formed as compared with a manner that a transpire passageway is attached at the outside the compressor body.

In the third aspect of the present invention, a radial bearing having an outer ring is inserted at the end portion of the shaft hole adjoining the crankcase chamber, and the throttle is constituted by a clearance gap between the outer ring of the radial bearing and the drive shaft. Accordingly, the third aspect of the present invention effectively contributes to the lubricating of the radial bearing and the cooling of the radial bearing, without affecting the forming of the front housing and assembling of parts constituting the compressor.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENT

Having generally described the present invention, a further understanding can be obtained by reference to the specific preferred embodiment which is provided herein for purposes of illustration only and are not intended to limit the scope of the appended claims.

Preferred Embodiment

A compressor according to the present invention will be hereinafter described with reference to a Preferred Embodiment thereof.

Figure 1:
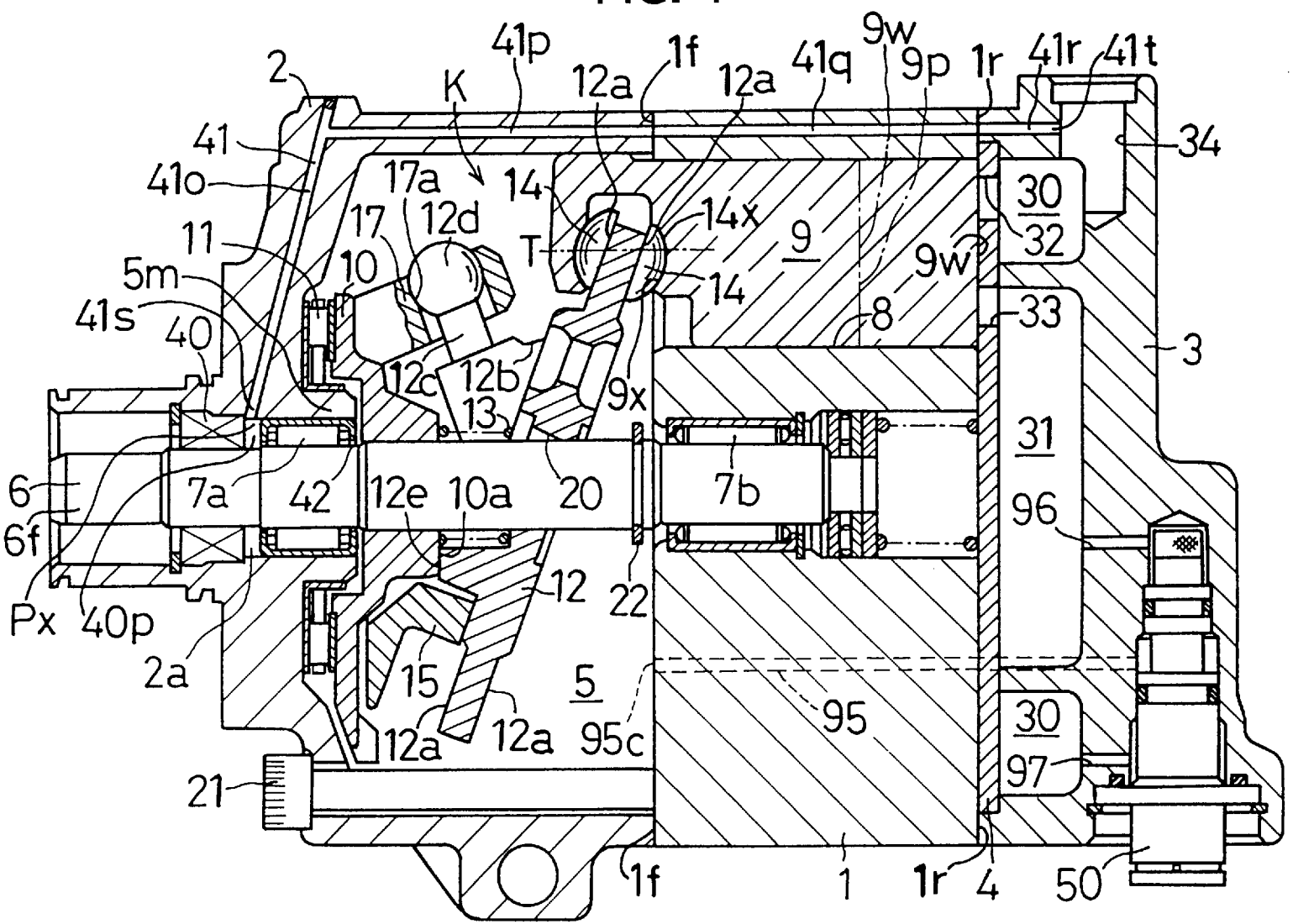
FIG. 1 illustrates a cross sectional view showing a variable capacity compressor.

As shown in FIG. 1, there is a cylinder block 1 having a front end If and a rear end 1r. The front end 1f of the cylinder block 1 is closed by a front housing 2, and the rear end 1r of the cylinder block 1 is closed by way of a valve plate 4 by a rear housing 3. These parts are connected together by bolts 21. The cylinder block 1 and the front housing 2 form a crankcase chamber 5 in which a drive shaft 6 extends in a direction of the shaft centre. The drive shaft 6 is rotatably supported by radial bearings 7*a,* 7*b*. The front end portion 6*f* of the drive shaft 6 is to be connected with a vehicle engine by way of an electro-magnetic clutch and a transmitting mechanism. Also, the cylinder block 1 has a plurality of bores 8 which are arranged around the drive shaft 6. The compressor has pistons 9 which are fitted in each of bores 8 to be reciprocated respectively.

The crankcase chamber 5 has a rotor 10 which is connected with the drive shaft 6, and a thrust bearing 11 is arranged between the rotor 10 and the front housing 2. The rotor 10, therefore, is capable of rotating synchronously with the drive shaft 6. The crankcase chamber 5 has a cam plate 12 which is located on one side of the rotor 10 and is rotated integrally with the drive shaft 6 via the rotor 10. The crankcase chamber 5 has an urging spring 13 which is disposed between the rotor 10 and the cam plate 12 and which usually urges the cam plate 12 backwards.

The cam plate 12 has sliding surfaces 12*a* which are opposite to each other to has a flatness and which are formed in the outer peripheral portion of the cam plate 12. The sliding surface 12*a* comes in contact with shoes 14. Each of shoes 14 exhibits a hemisphere shape having a convex spherical surface 14*x* which is engaged with a concave spherical surface 9*x* of the piston 9.

The compressor has a pair of brackets 12*b* projecting from the cam plate 12 at a location which is set inner than the sliding surface 12*a* and which faces the rotor 10. The pair of brackets 12*b* straddle a top dead centre "T" of the cam plate 12. One end portion of each of guiding pins 12*c* is fixed to the bracket 12*b*. The ball portion 12*d* is formed at the other end portion of the guiding pin 12*c*. So, a hinge mechanism "K" is constituted by the pair of brackets 12*b,* the corresponding guiding pins 12*c,* and the ball portions 12*d*.

The bracket 12*b,* the guiding pin 12*c,* and the ball portion 12*d* are plural, respectively.

The cam plate 12 has a bent through-hole 20 which is formed at the central portion of the cam plate 12. The bent through-hole 20 permits the cam plate 12 to be displaced on the drive shaft 6. There is a counter weight 15 installed by rivets at the bottom dead centre area of the cam plate 12. The counter weight 15 is outwardly extended from the centre line of the drive shaft 6. The counter weight 15 covers the sliding surface 12*a,* while avoiding the shoes 14 facing the rotor 10.

The cam plate 12 has a front end surface 12*e* which is centrally disposed in a radius direction of the cam plate 12. The front end surface 12*e* of the cam plate 12 comes in contact with the rear end surface 10*a* of the rotor 10; so, the cam plate 12 is regulated in its maximum angle. On the other hand, the cam plate 12 has a seat hole portion which comes in contact with a circlip 22 fixed onto the drive shaft 6; so, the cam plate 12 is regulated in its minimum angle.

Also, the rotor 10 has a pair of supporting arms 17 constituting the remnants of the aforesaid hinge mechanism "K". The supporting arm 17 is disposed at the upper portion of the rotor 10. The supporting arm 17 projects backwards along an axial direction of the drive shaft 6. The supporting arm 17 is arranged with the guiding pin 12*c* therein. The top end of the supporting arm 17 has a guide hole 17*a*. The guide hole 17*a* is arranged to approach the centre line of the drive shaft 6 from the outside of the drive shaft 6, and the guide hole 17*a* is parallel to an imaginary plane decided by the centre line of the drive shaft 6 and the top dead centre "T" of the cam plate 12. Orientation of the guide hole 17*a* is set to immovably hold the top dead centre of the piston 9, regardless of the inclination angles of the cam plate 12. The ball portion 12*d* is slidablly inserted into the guide hole 17*a*.

The rear housing 3 has a suction chamber 30 and a discharge chamber 31. The valve plate 4 has inlet ports 32 and outlet ports 33 opened to face the respective bores 8. The valve plate 4 and the end surface 9*w* of the pistons 9 are to form respective compression chambers 9*p* which are communicated with the suction chamber 30 by way of the inlet ports 32 and which communicated with the discharge chamber 31 by way of the outlet ports 33. The valve plate 4 is provided with suction valves (not shown) for opening and closing the respective inlet ports 32, and discharge valves (not shown) for opening and closing the respective outlet ports 33. The rear housing 3 has a suction hole 34 which communicates the suction chamber 30 with the outer refrigerant circuit (not shown). The suction hole 34 and the suction chamber 30 work as the suction pressure area of the present invention.

The rear housing 3 has a capacity controls valve 50 built-in for controlling a pressure of the crankcase chamber 5 in response to cooling demand. The compressor has: (1) a pressure-measuring passageway 97 communicated with the suction chamber 30; (2) a pressure-introducing passageway 96 communicated with the discharge chamber 31; and (3) a supplying passageway 95 having an opening 95*c* communicated with the crankcase chamber 5. The capacity control valve 50 has ports which are communicated with the pressure-measuring passageway 97, the pressure-introducing passageway 96, and supplying passageway 95, respectively.

Figure 2:
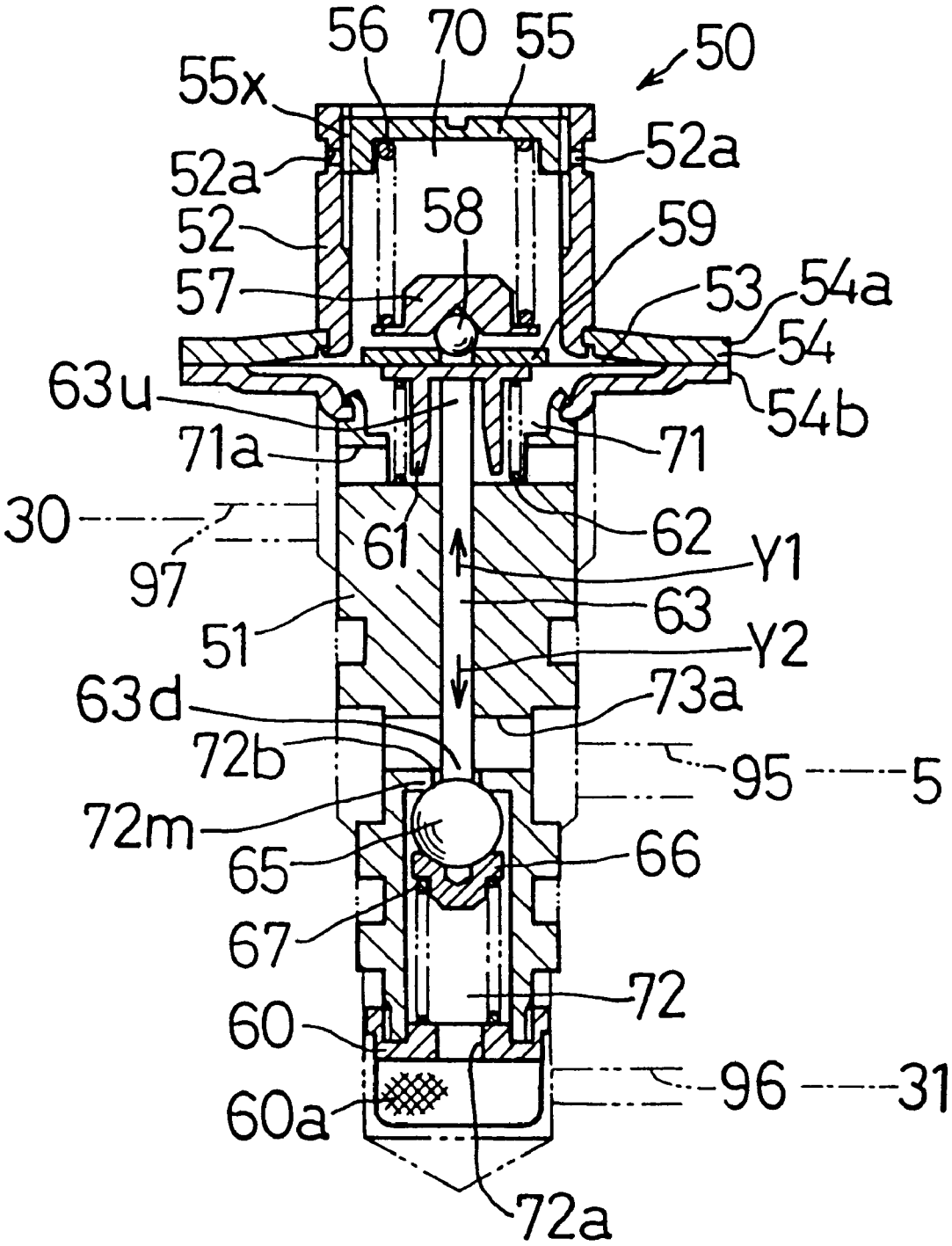
FIG. 2 illustrates an enlarged cross sectional view showing a capacity control valve disposed in the variable capacity compressor.

The capacity control valve 50 shown in FIG. 2 has a diaphragm 53 which is arranged by holding members 54 (54*a*, 54*b*) between a valve main body 51 and a sleeve 52. The diaphragm 53 works as a pressure sensitive mechanism. The sleeve 52 has an opening which is screwed by a lid plug 55. The valve 50 has an atmospheric chamber 70 which is formed by the sleeve 52, the lid plug 55, the diaphragm 53, and the holding member 54*a*. The sleeve 52 has pores 52*a* which are communicated with the atmospheric chamber 70 by a backlash 55*x* between the lid plug 55 and the sleeve 52 so as to keep the atmospheric chamber 70 an atmospheric pressure. The atmospheric chamber 70 stores an urging spring 56 having an urging force. The urging spring 56 is disposed between lid plug 55 and a presser 57 having a hat-shape in a cross sectional view. The presser 57 urged by the urging spring 56 is connected to a presser 59 having a ring shape via a ball 58, so the urging force of the spring 56 is transmitted to the diaphragm 53.

The valve main body 51 has a suction pressure chamber 71 which is formed between the diaphragm 53 and the holding member 54*b*. The suction pressure chamber 71 is communicated with the pressure-measuring passageway 97 and the suction chamber 30 by a port 71*a* formed in the valve main body 51. As a result, a suction pressure is supplied to the suction pressure chamber 71 by the pressure-measuring passageway 97. The suction pressure chamber 71 contains a presser 61 which comes in contact with the diaphragm 53 and which has a "II" shape in a cross sectional view. The capacity control valve 50 has an urging spring 62 which has an urging force and which is disposed between the presser 61 and the bottom surface of the suction pressure chamber 71. The presser 61 is connected with one end portion 63*u* of the rod 63 capable of sliding in the valve main body 51. The valve 50 has a ball valve 65 connected with the other one end portion 63*d* of the rod 63.

Also, the valve 50 has a discharge pressure chamber 72 formed at the end side of the valve main body 51. The discharge pressure chamber 72 contains a valve seat 72*m* at which the ball valve 65 is to be seated. The valve main body 51 has a lid 60 which closes the end opening of the discharge pressure chamber 72. The lid 60 has a port 72*a* formed to communicate with the discharge chamber 31 by way of the pressure-introducing passageway 96, thereby introducing a discharge pressure of the discharge chamber 31 into the discharge pressure chamber 72 of the control valve 50. The discharge pressure chamber 72 contains a presser 66, and an urging spring 67 which urges the presser 66 between the presser 66 and the lid 60. The presser 66 comes in contact with the ball valve 65. The urging spring 67 has a spring force for urging the ball valve 65.

On the other hand, the valve main body 51 has a port 73*a* communicated with the supplying passageway 95. The port 73*a* is communicated with the discharge pressure chamber 72 by way of a valve hole 72*b* formed at the surroundings of the rod 63. The lid 60 has a filter 60*a* facing the pressure-introducing passageway 96.

Nextly, the transpire passageway 41 showing the feature of the present invention will be further explained hereinafter.

The front housing 2 has a shaft sealing member 40 in the shaft hole 2*a* thereof for sealing the end portion 6*f* of the drive shaft 6. The shaft sealing member 40 has a sealing lip 40*m* for coming into contact with the drive shaft 6, and the shaft sealing member 40 is formed of polymer based material, such as rubber or resin.

Figure 3:
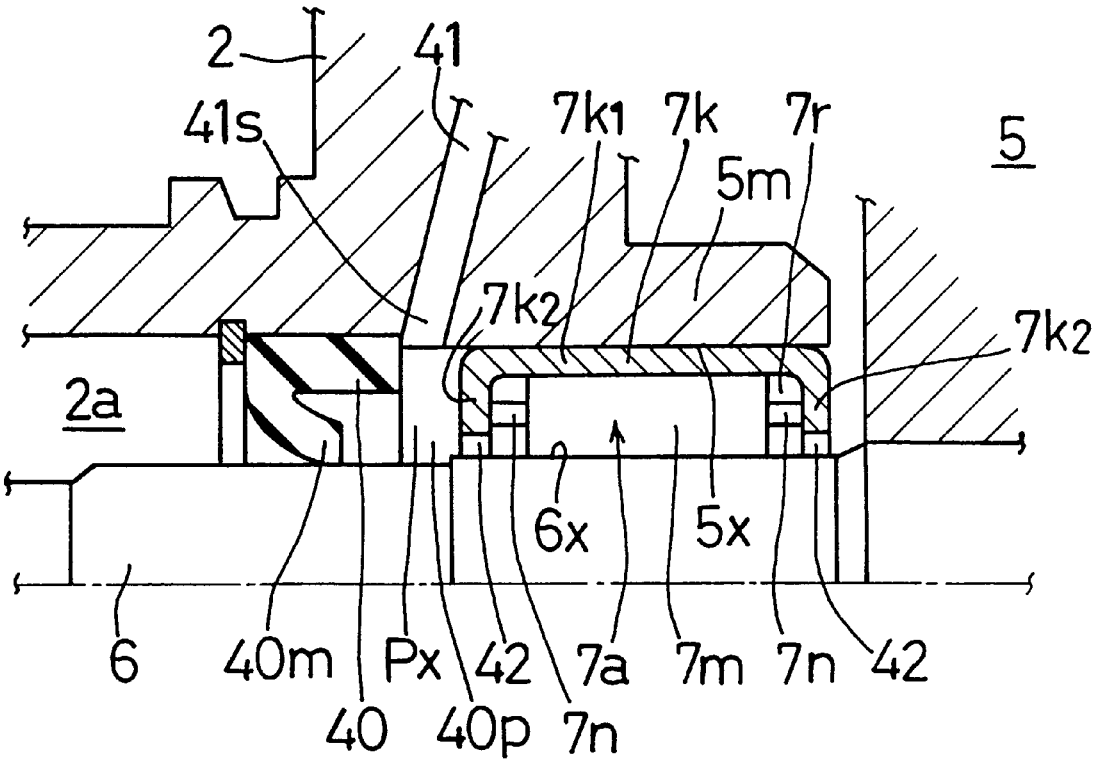
FIG. 3 illustrates an enlarged cross sectional view showing the neighborhood of a shaft hole.

A radial bearing 7*a*, a needle bearing, is arranged in the rear side with respect to the shaft sealing member 40, namely, in the hole end portion 5*m* adjoining the crankcase chamber 5. So, the radial bearing 7*a* faces the crank chamber 5 by way of the rotor 10. As shown in FIG. 3, the radial bearing 7*a* has an outer ring 7*k* having a channel ring space 7*r*, a plurality of rollers 7*m* arranged in a circumferential direction in the channel ring space 7*r*, and a cage 7*n* for holding the rollers 7*m* in the outer ring 7*k*. As shown in FIG. 3, the outer ring 7*k* faces an inner peripheral surface 5*x* of the hole end portion 5*m* of the front housing 2. The rollers 7*m* face an outer peripheral surface 6*x* of the shaft 6. As shown in FIG. 3 showing a cross sectional view, the outer ring 7*k* has a ring portion $7k_1$ formed along the axial direction and end ring portions $7k_2$ formed inwardly along the radius direction from ends of the ring portion $7k_1$.

The compressor has the transpire passageway 41. As shown in FIG. 1, the transpire passageway 41 is formed, in sequence, through the body of the front housing 2, the body of the cylinder block 1, and the body of the rear housing 3 so as to connect to the suction hole 34. The transpire passageway 41 has one end passageway portion 41*s* which is opened between the radial bearing 7*a* and the shaft sealing member 40, namely, which is opened at the sealed portion 40*p* being sealed by the shaft sealing member 40 in the shaft hole 2*a*. Also, the transpire passageway 41 has another end passageway portion 41*t* opened at the suction hole 34 formed in the rear housing 3.

As shown in FIG. 1, the transpire passageway 41 has a passageway 41*o* formed in the front housing 2 along a radius direction, a passageway 41*p* formed in the body wall of the front housing 2 along an axial direction, a passageway 41*q* formed in the body wall of the cylinder block 1 along an axial direction, and a passageway 41*r* formed in the body wall of the rear housing 3 along an axial direction.

A throttle 42 is constituted by a clearance gap between the inner peripheral surface 5*x* of the hole end portion 5*m* adjoining the crankcase chamber 5 and an outer peripheral surface 6*x* of the drive shaft 6.

As shown in FIG. 3, in the present embodiment, the throttle 42 is formed by a clearance gap between the end ring portions $7k_2$ of the outer ring 7*k* of the radial bearing 7*a* and the outer peripheral surface 6*x* of the drive shaft 6.

The transpire passageway 41 is to exclusively extract the refrigerant gas of the crankcase chamber 5 into the suction pressure area, the suction hole 34. The refrigerant gas of the crankcase chamber 5 is not extracted by way of other passageways.

The compressor of the present embodiment is constituted in the aforesaid construction. A force "F1" is the resultant force adding a pressure of the suction pressure chamber 71 and the spring force of the urging spring 62. A force "F2" is the resultant force adding an atmospheric pressure of the atmospheric chamber 70 and the spring force of the urging spring 56. When the compressor is stopped, a pressure in the compressor is balanced at a higher pressure than a predetermined suction-pressure value, accordingly, the force "F1" is larger than the force "F2", and the force "F1" works to the diaphragm 53. The rod 63, therefore, is displaced in a direction "Y1" in FIG. 2, the ball valve 65 is seated onto the valve seat 72*m* to close the valve hole 72*b,* closing the supplying passageway 95, thereby closing the communication between the discharge chamber 31 and the crankcase chamber 5.

From such situation, when the drive shaft 6 is rotated by way of a electro-magnetic clutch, the cam plate 12 is rotated with oscillation by way of the rotor 10 and the hinge mechanism "K", reciprocating the piston 9 to start compression work. In the early stage of the compression work, the suction pressure and temperature of the vehicle room are generally higher, the capacity control valve 50 keeps the supplying passageway 95 closed, as above-mentioned. Thus, the blow-by gas returned to the crankcase chamber 5 during compression work flows into the suction chamber 30 by way of the transpire passageway 41. Thus, a differential pressure between the pressure of the crankcase chamber 5 and suction pressure is kept lower than the predetermined suction-pressure value; so, the pistons 9 are driven to exhibit a maximum piston-stroke; namely: the compressor is driven at the full capacity.

When the compressor is continuously driven at the full capacity, the temperature of the vehicle room becomes gradually lower, the suction pressure becomes lower than the predetermined suction-pressure value, and thereby the force "F1" is defeated by the force "F2". Accordingly, this operates the diaphragm 53 to the presser 61, displacing the rod 63 in a direction "Y2", further detaching the ball valve 65 from the valve seat 72*m.* Also, this opens the valve hole 72*b,* the supplying passageway 95, further opening the pressure-introducing passageway 96, the port 72*a,* the discharge pressure chamber 72, and the port 73*a.* So, the supplying passageway 95 introduces the high pressure refrigerant gas of the discharge chamber 31 into the crankcase chamber 5, thereby increasing the pressure of the crankcase chamber 5.

When the pressure of the crankcase chamber 5 becomes higher to increase the differential pressure between the pressure of the crankcase chamber 5 and the suction pressure, the compressor decreases the inclination angle of the cam plate 12 and the stroke of the piston 9, and the compressor is shifted into a small capacity mode. Subsequently, the capacity control valve 50 closes the valve hole 72*b* by ball valve 65, and closing the supplying passageway 95 again after the suction pressure increases again in response to the increase in temperature.

The capacity control of the compressor is carried out in the above-mentioned way. When cooling demand is large, only the blow-by gas flows into the crankcase chamber 5. When cooling demand is small, the high pressure refrigerant gas is positively supplied into the crankcase chamber 5 by way of the capacity control valve 50 and the supplying passageway 95.

In either case, a part of the high pressure refrigerant gas flows along the throttle 42 which is disposed at the hole end portion 5*m* of the shaft hole 2*a* of the front housing 2; so, a part of the high pressure refrigerant gas flows toward the suction pressure area, namely the suction hole 34, exclusively by way of the transpire passageway 41 adjoining the sealed portion 40*p* sealed by the shaft sealing member 40—a feature of the present invention.

In other words, the exclusive flow stream is generated in the refrigerant gas in the crankcase chamber 5 by the differential pressure, passing through the vicinity of the shaft sealing member 40. The exclusive flow stream, whose quantity is large, lubricates and cools the shaft sealing member 40 effectively.

In the case where the compressor increases the pressure of the crankcase chamber 5 so as to control the capacity, the high pressure refrigerant gas containing oil is positively supplied into the crankcase chamber 5 in controlling the capacity. This further generates the gas-flow stream passing through the vicinity of the shaft sealing member 40. So, the shaft sealing member 40 is effectively lubricated and cooled.

In the present embodiment, the throttle 42 is constituted by the gap between the inner peripheral surface 5*x* of the hole end portion 5*m* adjoining the crankcase chamber 5 and the outer peripheral surface 6*x* of the drive shaft 6, the back pressure "Px" (shown in FIG. 1) with respect to the shaft sealing member 40 is decreased to equal to the pressure of the suction pressure area, the suction hole 34.

Accordingly, the present embodiment reduces the load applied to the seal portion, and it obtains a cooling ability on the basis of the reduced pressure caused by the throttle 42.

Also, the throttle 42 is constituted by the clearance gap between the drive shaft 6 and the outer ring 7*k* of the radial bearing 7*a* which is disposed at the hole end portion 5*m* adjoining the crankcase chamber 5 in the shaft hole 2*a*. Accordingly, the present embodiment additionally obtains the lubricating ability and cooling effect with respect to the radial bearing 7*a,* without affecting the forming of the front housing 2 and the assembling of the parts.

In another embodiment of the present invention, it is possible that decreasing the inner diameter of hole end portion 5*m* of the shaft hole 2*a* constitutes another throttle.

What is claimed is:

1. A variable capacity compressor, comprising:

a cylinder block including a plurality of bores arranged therein, constituting a body of said compressor, and having a front end, and a rear end;

a front housing including a shaft hole, and a crankcase chamber disposed in the inside thereof, said front housing closing said front end of said cylinder block, and said crankcase chamber having a rotor and a hinge mechanism;

a drive shaft rotatably supported by said cylinder block and said front housing, said drive shaft having an end portion disposed in said shaft hole of said front housing;

a shaft sealing member disposed in said shaft hole between said drive shaft and said front housing for sealing said shaft hole of said front housing;

a rear housing including a suction pressure area and a discharge pressure area, and said rear housing closing said rear end of said cylinder block;

a cam plate connected to be inclined with respect to said drive shaft, and connected with said rotor by way of said hinge mechanism to synchronously be rotated with said drive shaft;

a plurality of pistons associated with said cam plate for reciprocating in each of said bores;

a capacity control valve for controlling a pressure of said crankcase chamber by supplying a discharge pressure from said discharge pressure area to said crankcase chamber, said capacity control valve for varying an inclination angle and a piston stroke on the basis of a differential pressure between a suction pressure and said pressure of said crankcase chamber; and the improvement comprising;

a transpire passageway exclusively being communicated with said suction pressure area, having one end passageway portion being opened at a sealed portion being sealed by said shaft sealing member disposed in said shaft hole, and having another end passageway portion being opened said suction pressure area;

and a throttle constituted by a clearance gap between an inner peripheral surface of an end portion of said shaft hole adjoining said crankcase chamber and an outer peripheral surface of said drive shaft.

2. A variable capacity compressor according to claim 1, wherein said transpire passageway passes through an inside of a body of said front housing, an inside of a body of said cylinder block, and an inside of a body of said rear housing, for communicating with said suction pressure area.

3. A variable capacity compressor according to claim 1, wherein a radial bearing having an outer ring is inserted at said end portion of the shaft hole adjoining said crankcase chamber, said radial bearing for rotatably supporting said drive shaft, and said throttle is constituted by a clearance gap between said outer ring and said outer peripheral surface of said drive shaft.

4. A variable capacity compressor according to claim 3, wherein said radial bearing and said shaft sealing member are adjacent to each other in said shaft hole, and said radial bearing faces said crankcase chamber.

5. A variable capacity compressor according to claim 4, wherein said one end passageway portion of said transpire passageway is opened between said radial bearing and said shaft sealing member in said shaft hole.

6. A variable capacity compressor according to claim 1, wherein said crankcase chamber is controlled by said capacity control valve in such a manner that refrigerant gas containing lubricating oil is supplied into said crankcase chamber.

7. A variable capacity compressor according to claim 1; wherein said radial bearing has an outer ring having a channel ring space and facing said inner peripheral surface of said end portion of the shaft hole adjoining said crankcase chamber, and a plurality of rollers arranged in a peripheral direction in said channel ring space and rotatably facing said outer peripheral surface of said drive shaft; and wherein said throttle is constituted by a clearance gap between said outer ring of said radial bearing and said outer peripheral surface of said drive shaft.

8. A variable capacity compressor according to claim 1; wherein said compressor is used for an air-conditioner, said capacity control valve controls a pressure of said crankcase chamber in response to a cooling demand; and wherein said compressor has a supplying passageway communicated with said crankcase chamber and said capacity control valve, and when said cooling demand is small, high pressure refrigerant gas is supplied into said crankcase chamber by way of said supplying passageway by said capacity control valve.

9. A variable capacity compressor according to claim 8; wherein said capacity control valve has a discharge pressure chamber communicated with said discharge chamber of said rear housing, a valve hole formed between said discharge pressure chamber and said supplying passageway, and a valve body for closing and opening said valve hole; and wherein when said cooling demand is small, said valve body opens said valve hole to supply said high pressure refrigerant gas of said discharge chamber of said rear housing into said crankcase chamber by way of said valve hole and said supplying passageway.

* * * * *